US006343704B1

(12) United States Patent
Prentiss

(10) Patent No.: US 6,343,704 B1
(45) Date of Patent: Feb. 5, 2002

(54) INFANT FEEDING NIPPLE

(76) Inventor: John Gilbert Prentiss, Rte. 1 Box 194, Pamplin, VA (US) 23958

( * ) Notice: Subject to any disclaimer, the term of this patent is extended or adjusted under 35 U.S.C. 154(b) by 0 days.

(21) Appl. No.: 09/410,906

(22) Filed: Oct. 2, 1999

(51) Int. Cl.[7] ..... A61S 11/00
(52) U.S. Cl. ..... 215/11.1; 215/11.4; 606/234
(58) Field of Search ..... 215/11.1, 11.4; 606/234, 235, 236, 11.5, 11.3, 11.6

(56) References Cited

U.S. PATENT DOCUMENTS

| | | | | | |
|---|---|---|---|---|---|
| 582,159 | A | | 5/1897 | Heuer | 215/11.1 |
| 981,072 | A | * | 1/1911 | Decker | 215/11.1 |
| 1,351,328 | A | * | 8/1920 | Decker | 215/11.1 |
| 1,588,846 | A | | 6/1926 | McGeary | 215/11.1 |
| 2,223,179 | A | * | 11/1940 | Lougheed | 215/11.1 |
| 2,628,906 | A | * | 2/1953 | Horan | 315/11.1 X |
| 2,954,030 | A | * | 9/1960 | Jozwiak | 215/11.1 |
| 2,986,296 | A | * | 5/1961 | Bannister et al. | 215/11.1 |
| 3,179,299 | A | * | 4/1965 | Allegraud et al. | 215/40 X |
| 3,966,869 | A | * | 6/1976 | Kohl | 215/11.1 X |
| 4,623,069 | A | | 11/1986 | White | 215/11.1 |
| 4,765,479 | A | | 8/1988 | Hsu | 215/11.1 |
| 4,993,568 | A | * | 2/1991 | Morfuji et al. | 215/11.1 |
| 5,004,473 | A | * | 4/1991 | Kalantar | 215/11.1 X |
| 5,101,991 | A | * | 4/1992 | Morifuji et al. | 215/11.1 |
| 5,101,992 | A | * | 4/1992 | Serre | 215/11.1 X |
| 5,544,766 | A | | 8/1996 | Dunn et al. | 215/11.1 |
| 5,598,809 | A | * | 2/1997 | McInnes | 215/11.1 X |
| 5,667,084 | A | | 9/1997 | Duggal et al. | 215/11.4 |
| 5,747,083 | A | | 5/1998 | Raymond et al. | 426/117 |

FOREIGN PATENT DOCUMENTS

| | | | | |
|---|---|---|---|---|
| DE | 1957739 | * | 5/1971 | 215/11.1 |
| FR | 2700689 | * | 7/1994 | 215/11.1 |
| GB | 2215318 | * | 9/1989 | 215/11.1 |

* cited by examiner

*Primary Examiner*—Allan N. Shoap
*Assistant Examiner*—Lien Ngo

(57) ABSTRACT

An artificial infant feeding nipple is disclosed comprising a hollow tubular fluid conduit having first and second open ends and a substantially transverse membrane closing the conduit. In the preferred embodiment, the membrane is perforated by a plurality of minimal diameter fluid apertures fully penetrating the membrane and extending beyond one face of the membrane within integrally formed hollow nubs having closed ends. Each closure nub is removable to permit fluid flow through the related aperture. Additionally, the recessed membrane provides reinforcing against collapse of the nipple tube while permitting the delivery end of the nipple to be plugged to prevent leakage when not in use.

10 Claims, 1 Drawing Sheet

INFANT FEEDING NIPPLE

FIELD OF INVENTION

The present invention relates to artificial feeding nipples, more specifically to one including incrementally adjustable flow rate.

BACKGROUND

Natural breastfeeding is unquestionably the best way to nurture an infant. Among the many benefits of breastfeeding, the way an infant suckles on the breast is important to proper muscle, speech and dental development. However, artificial feeding systems are appropriately used in many circumstances and should be designed to embrace the advantages of natural breastfeeding to the greatest extent possible.

For most of the past century, the majority of artificial feeding nipples have been made of latex and have been sold with a single aperture. The factory installed aperture in latex nipples could be enlarged by a care giver using a hot needle, and new apertures could likewise be added. Due in part to infants' allergenic reactions to latex, silicone nipples have become increasingly popular in recent years. However, it is not safe for care givers to open additional apertures in silicone nipples as was formerly done with latex because of the tendency of silicone to tear. Consequently many manufacturers offer silicone nipples in a variety of flow specific rates. When an increase in flow rate is necessary or desirable, nipples with additional or larger apertures are purchased and the former nipples discarded. One such system is Dunn and Suarez, U.S. Pat. No. 5,544,766. Other novel approaches to flow control are cited by Duggal U.S. Pat. No. 5,667,084 and by Raymond, et al, U.S. Pat. No. 5,747,083. Hsu, U.S. Pat. No. 4,765,497 claims a nipple with tapered nubs appended to the outer surface which may be clipped back to incrementally increase flow. Appendage of the nubs to the exterior surface of the nipple necessitates unpleasant contact on the infant users' sensitive palate, particularly once the protruding nubs have been partially clipped leaving distinct edges. A further drawback of this design is that as tapered apertures are opened at wider diameters, the nipple leaks far more readily. Three open apertures of say 0.010" diameter each are much less likely to leak than one aperture providing an equal rate of flow.

Another important aspect of artificial nipple design is the way in which the baby latches on to the nipple and the suckling action required to draw fluid. White, U.S. Pat. No. 4,623,069 and Busnel, U.S. Pat. No. 5,673,806, both attempt to more closely simulate the muscle development and fluid flow common to natural breastfeeding. Artificial feeding nipples tend to collapse, sometimes to the point of completely closing the flow of fluid through them. As a result, manufacturers have installed ribs inside nipples to help prevent opposite sides of the tubular walls from fully contacting. Heller, U.S. Pat. No. 582,159 and McGeary, U.S. Pat. No. 1,588,846 are some early designs which may have prevented nipple collapse, but created unacceptable sanitation problems. The typical tubular nipple in use today can easily collapse, offering little resistance to an infant's suckling action. This may result in impaired development of facial muscles, improper dental development and may even be the cause of later speech impediments.

Sanitation in infant feeding nipples is extremely important. The ideal nipple design would permit relatively easy access to all inner surfaces of the nipple for thorough cleaning and would prevent or minimize potential contamination of the outside surface while being stored. Nipple dust caps now frequently in use include a small cup on the inside surface to close the nipple when the dust cap is installed on the bottle, intending to prevent leakage while in transit. Some fluid inevitably leaks into the innermost surfaces of this cup, and being out of sight, the cavity is often left improperly cleaned. When the cap is re-installed, the clean nipple thus may be contaminated with bacteria growing in the recesses of the cap.

SUMMARY OF INVENTION

The preferred embodiment includes a nipple tube having an internal membrane which closes the tube while providing internal support against collapse. The membrane carries a plurality of small diameter apertures, only one of which is opened upon purchase. The closure nubs are turned inward to avoid contact with the infant's palate or tongue, enabling incremental flow adjustment without exposed closure nubs. Using a single aperture requires a strong suck, and discourages babies who are breastfeeding from giving up the breast in favor of the bottle. As the infant matures, additional apertures are opened to increase flow without requiring purchase of new nipples.

The recessed tip encourages muscle development and provides a more pleasant, natural sensation in the mouth and on the palate of the infant user. It is easy to clean due to the shortened inner cavity and related ease of inverting the nipple tube. Also, there are no complex or inaccessible interior elements to pose cleaning problems. The recessed tip further includes a female annular sealing surface which allows the use of a small protrusion on the inside of the dust cap to sealingly plug the corresponding recess in the tip of the nipple. The improved seal is secure for travelling, while the plug is easy to clean, and is more likely to be noticed if contaminated.

OBJECT AND ADVANTAGES

A first object of the present invention is to provide incremental multiple flow options in a single nipple without external protrusions which might cause discomfort to the infant user. A second object is to provide a nipple that resists collapse and improves infant latch-on. A third object is to provide a nipple with a recessed tip which may be sealingly engaged by a corresponding nub in the dust cap to prevent leakage in transit. A fourth object is to provide a more sanitary nipple design that is easily cleaned. A fifth object is to provide a more sanitary nipple engagement member in the dust cap whereby there is no relatively inaccessible cavity to harbor bacteria. A sixth object is to provide a nipple that improves sensation on the infant user's palate. A seventh object is to provide a platform for aperture closure nubs that can be accessed readily from the inside of the nipple. Further objects and advantages will become apparent upon review of the appended specification and drawing figures.

DETAILED DESCRIPTION OF THE DRAWINGS

Figure 1:
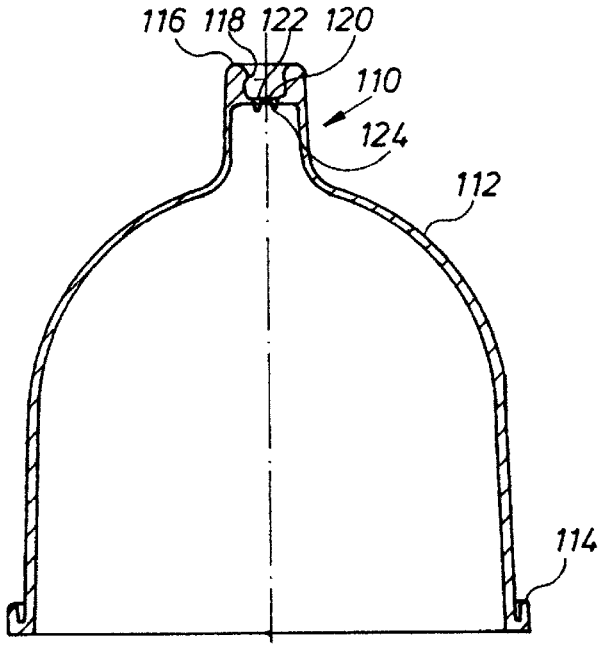
FIG. 1 is a section of the preferred embodiment having multiple apertures.

FIG. 1 is a cross section of a preferred embodiment appended to the inventor's breast bottle U.S. Pat. No.

5,690,679. Nipple 110 is integrally molded with dome 112 and attachment flange 114. Nipple 110 includes an open distal end 116 molded with optional sealing surface 118. Closure membrane 120 is recessed from distal end 116 and is molded with a plurality of preformed apertures 122 which are closed by corresponding nubs 124 in the molding process. A single nub 124 is optionally removed at the time of manufacture and additional nubs 124 are removed by the care giver as necessary to incrementally increase flow rate. Clippers, small scissors or other suitable implement may be used to remove nubs 124. Nipple 110 and related parts are typically injection molded of a suitable resilient material appropriate for food contact such as silicone, latex and compounds thereof. Many thermoset and thermoplastic elastomers such as Santoprene® and Dynaflex® also may be used, as well as skinned resilient foams. Compression molding, dipping and other molding approaches also may be suitable for this application.

Figure 2:
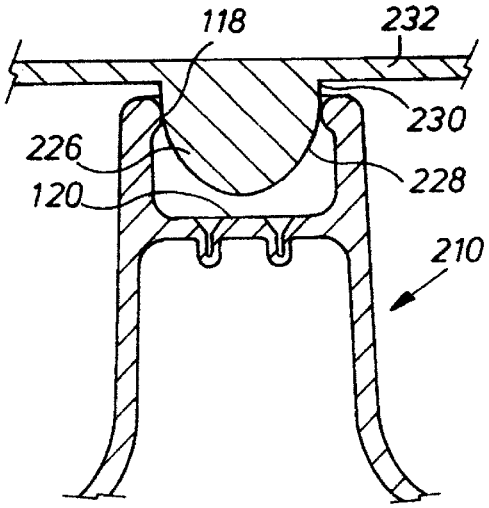
FIG. 2 is a section of the nipple of FIG. 1 engaged by a closure plug.

FIG. 2 is a cross section of the nipple 210 portion of the embodiment pictured in FIG. 1, sealed with closure plug 226. Plug 226 is an independent member which sealingly engages sealing surface 218, thereby preventing contents from leaking. Plug 226 includes an optionally rounded or chamfered alignment tip 228 and tapered walls 230. Minimal taper will result in an optimum seal. Full engagement should occur prior to alignment tip 228 contacting membrane 220. Plug 226 is typically mounted on the inner surface of dust cover 232 and is located so as to engage and seal nipple 210 when dust cover 232 is fully installed on the related base or container. Plug 226 may be attached to any suitable carrier, but care should be taken not to use a carrier so small that it might be ingested by an infant or toddler.

Figure 3:
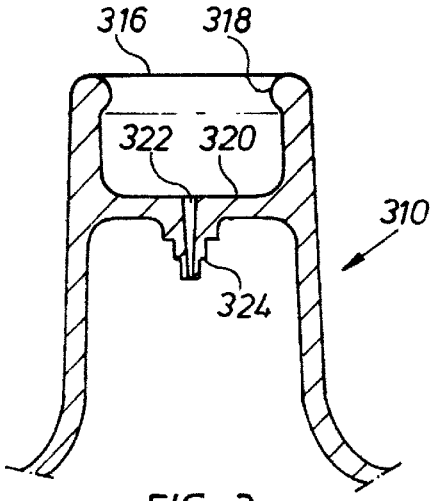
FIG. 3 is a section of an embodiment having a single tapered aperture

FIG. 3 is a cross section of an alternative embodiment of the subject invention. Nipple 310 includes an open distal end 316 molded with optional sealing surface 318. Membrane 320 is recessed from distal end 316 and is molded with a single preformed tapered aperture 322 closed by nub 324 in the molding process. In this embodiment, nub 324 is shown located on the inside surface of membrane 320. Aperture 322 is sized to be approximately 0.030" at the intersection of nub 324 and the inside surface of membrane 320. Aperture 322 tapers to approximately 0.010" at its smallest tip. Nub 324 is ideally molded or trimmed upon manufacture to provide a minimal flow rate through the 0.010" diameter. As the infant user's needs increase, nub 324 is clipped back to expose increasingly larger cross sections of aperture 322, thereby increasing flow rate. Tear lines may be molded in to facilitate accurate adjustment.

Ramifications and Scope

Many alternatives exist for the construction of the subject nipple including nuances of shape and size, use of various materials, processes, and variations in the size, number, and location of apertures. Alternative methods are contemplated for closing the nipple end when using a dust cover or an independent plug member. Tear lines may be molded into the nubs and various combinations of the elements of the invention are contemplated. The general design may successfully be used as a pacifier, reducing confusion between the subject nipple and a corresponding pacifier and providing reinforcement against collapse. It is therefore intended that the drawings depict preferred embodiments without limiting that which is more fully delineated in the appended claims.

I claim:

1. An adjustable flow nipple for use in conjunction with an infant feeding system wherein the improvements comprise a hollow elastomeric tubular conduit having one open supply end, one open discharge end, and a substantially transverse membrane spanning and closing the inner diameter of said tubular conduit, said transverse membrane being recessed from the discharge end of said conduit to provide reinforcing against collapse of said conduit, said transverse membrane further including at least one distinct fluid aperture penetrating said membrane to permit fluid flow from said supply end to said discharge end, said aperture extending beyond one face of said membrane, said extended aperture further being enclosed within an integrally formed hollow nub having a closed distal end, said closed distal end being substantially removable to permit fluid flow through said aperture, said adjustable flow nipple further including means to sealingly attach said supply end to said infant feeding system.

2. The adjustable flow nipple of claim 1 wherein a plurality of said apertures with said integrally formed hollow nubs are employed.

3. The adjustable flow nipple of claim 1 wherein said aperture is tapered with a corresponding closure nub, said nub being incrementally removable to increase flow rate.

4. The adjustable flow nipple of claim 1 wherein said supply end comprises a breast-like resilient dome.

5. The adjustable flow nipple of claim 1 wherein said means to sealingly attach said supply end comprises an annular flange.

6. The adjustable flow nipple of claim 1, wherein said nub is molded with means to indicate specific points of severance to obtain predetermined flow rates.

7. The adjustable flow nipple of claim 1, wherein said discharge end includes a female annular sealing surface for engagement by a corresponding plug for sealing said nipple when not in use.

8. The adjustable flow nipple of claim 7, wherein said plug is attached to a dust cover.

9. The adjustable flow nipple of claim 1 wherein the inner surfaces of said conduit are non-parallel.

10. In a pacifier, a nipple lip recessed to imitate contours of an adjustable flow nipple the nipple tip comprises a hollow elastomeric tubular conduit having one open supply end, one open discharge end, and a substantially transverse membrane spanning and closing the inner diameter of said tubular conduit, said transverse membrane being recessed from the discharge end of said conduit to provide reinforcing against collapse of said conduit, said transverse membrane further including at least one distinct fluid aperture penetrating said membrane to permit fluid flow from said supply end to said discharge end, said aperture extending beyond one face of said membrane, said extended aperture further being enclosed within an integrally formed hollow nub having a closed distal end, said closed distal end being substantially removable to permit fluid flow through said aperture, said adjustable flow nipple further including means to sealingly attach said supply end to said infant feeding system.

* * * * *